US007367799B2

(12) United States Patent
Rölver et al.

(10) Patent No.: US 7,367,799 B2
(45) Date of Patent: May 6, 2008

(54) COOLER FOR COOLING CLINKER

(75) Inventors: Ewald Rölver, Beckum (DE); Klaus Bornhütter, Hamm (DE); Günter Milewski, Ennigerloh (DE); Hermann Niemerg, Ennigerloh (DE)

(73) Assignee: Polysius AG, Beckum (DE)

( * ) Notice: Subject to any disclaimer, the term of this patent is extended or adjusted under 35 U.S.C. 154(b) by 131 days.

(21) Appl. No.: 10/574,309

(22) PCT Filed: Sep. 22, 2004

(86) PCT No.: PCT/EP2004/010638

§ 371 (c)(1),
(2), (4) Date: Apr. 3, 2006

(87) PCT Pub. No.: WO2005/047796

PCT Pub. Date: May 26, 2005

(65) Prior Publication Data

US 2007/0042311 A1 Feb. 22, 2007

(30) Foreign Application Priority Data

Oct. 20, 2003 (DE) ..... 103 48 590

(51) Int. Cl.
*F23H 11/24* (2006.01)

(52) U.S. Cl. ..... 432/78; 432/77; 110/281

(58) Field of Classification Search ..... 432/77, 432/78; 110/267–285
See application file for complete search history.

(56) References Cited

U.S. PATENT DOCUMENTS 5,837,052 A * 11/1998 Oates et al. ..... 106/705
5,976,243 A * 11/1999 Oates et al. ..... 106/767

FOREIGN PATENT DOCUMENTS

DE 4334901 A 4/1995

* cited by examiner

*Primary Examiner*—Gregory Wilson
(74) *Attorney, Agent, or Firm*—John K. McCulloch

(57) ABSTRACT

The invention relates to a cooler for cooling clinker with a device for removal of a sample of the clinker, wherein the cooler has a first cooler section, a second cooler section and a crusher disposed between them, and the device for removal of a sample of the clinker is disposed in a region between the first and the second cooler section.

2 Claims, 1 Drawing Sheet

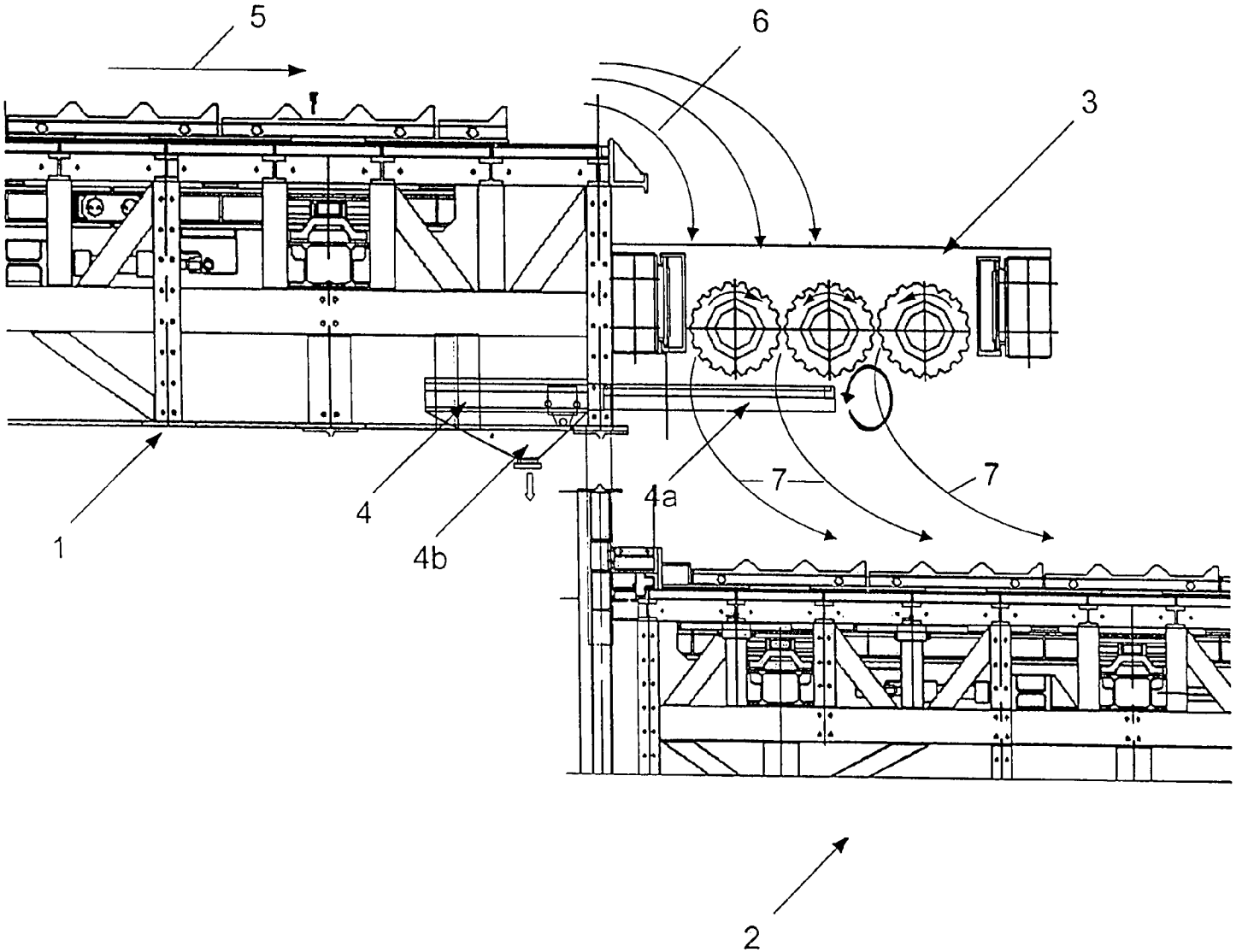
3
6
5
7
7
4a
4b
4
1
2

COOLER FOR COOLING CLINKER

The invention relates to a cooler for cooling clinker with a device for removal of a sample of the clinker.

BACKGROUND OF THE INVENTION

In order to ensure that the quality of the clinker is as constant as possible, samples of the clinker are taken and examined. It is then possible to influence the raw meal composition, the fuel regulation, etc., as a function of the result. Because of the high temperatures of the clinker coming out of the kiln and falling onto the cooler such samples can only be examined with regard to their chemical properties. The formation of clinker minerals is only terminated when the temperature of the clinker falls below approximately 720° C.

In order to analyse the clinker both with regard to its chemical properties and with regard to its mineralogical properties, the prior art mentions that sampling is carried out after the cooler. Due to the relatively long residence time of the clinker in the cooler an intervention into the preceding method sections can only be undertaken with a substantial loss of time.

The object of the invention, therefore, is to provide a cooler for cooling clinker with a device for the removal of a sample of the clinker, so that comprehensive information concerning the properties of the clinker can be collected as contemporaneously as possible.

This object is achieved according to the invention in that the cooler has a first cooler section, a second cooler section and a crusher disposed between them, and the device for removal of a sample of the clinker is disposed in a region between the first and the second cooler sections.

SUMMARY OF THE INVENTION

According to a preferred embodiment the device for removal of a sample of the clinker is disposed in a region where the temperature of the clinker is between 300° C. and 700° C., preferably between 450° C. and 550° C.

Moreover, due to the location of the sampling between the first and the second cooler section it is possible to take a sample with a representative grain size spectrum. In a design which is known in the prior art the sample falls downwards through a hole in the grate plate in a central region of the cooler.

The device for removal of a sample of the clinker is preferably disposed in a region between the crusher and the second cooler section.

Further embodiments of the invention are explained in greater detail with reference to the description of an embodiment and the drawing.

THE DRAWINGS

The drawing shows a schematic cross-sectional representation of the cooler in the region between the first and the second cooler sections.

THE DISCLOSED EMBODIMENT

The illustrated cooler basically comprises a first cooler section 1, a second cooler section 2 as well as a crusher 3 disposed between them. The second cooler section 2 is disposed lower than the first cooler section 1, so that the material from the first cooler section 1 proceeds into the crusher 3 and the second cooler section 2 can be disposed below the crusher. The comminuted material then falls from the crusher 3 onto the second cooler section 2.

In the illustrated embodiment the cooler is constructed with a stationary aerating base, wherein the material for cooling is moved over the aerating base by suitable conveying elements which are movable to and fro. However, within the scope of the invention it would also be possible to design the cooler as a so-called reciprocating grate cooler with rows of grate plates which are alternately stationary and movable to and fro. For cooling of the material, cooling air flows upwards from below through the cooler in a manner which is known per se.

Furthermore, below the crusher 3 a device 4 is provided for removal of a sample of the clinker. This device has a suitable sampler 4*a* which at desired intervals takes samples of the comminuted clinker material which is falling downwards. The sample is then dispensed into a hopper 4*b* and from there is delivered in a suitable manner to an analysing means which is not shown in greater detail. The analysis can be carried out for example using an X-ray fluorescence method and/or using a method of X-ray diffractometry.

The clinker usually falls out of the kiln onto the first cooler section 1 at temperatures of approximately 1,400° C. There the clinker is transported in the direction of the arrow 5 and supplied with cooling air. At the end of the first section the clinker passes according to the arrow 6 into the crusher 3, where comminution of the clinker takes place.

The sampling takes place in the region between the crusher 3 and the second cooler section 2 in that a sample is taken from the clinker falling out of the crusher. In accordance with the arrow 7 the remainder of the crushed clinker proceeds to the second cooler section for further cooling.

However, within the scope of the invention it would also be possible to carry out the sampling with a suitable sampler between the cooler section 1 and the crusher 3.

The first cooler section is dimensioned in terms of its length and is supplied with cooling air in such a way that the clinker in the region where it is sampled has a temperature between 300° C. and 700° C., preferably between 450° C. and 550° C., in which case the sampling is provided as early as possible in order to be able to act as contemporaneously as possible on the preceding method sections.

Since the formation of the clinker minerals is only terminated when the temperature falls below approximately 720° C., the temperature of the clinker during sampling should not lie significantly above 650° C.

The provision of a crusher 3 between the two cooler sections makes it possible on the one hand to carry out sampling with a representative grain size spectrum and on the other hand to undertake the quickest possible analysis of the clinker.

We claim:

1. Cooler for cooling clinker with a device for removal of a sample of the clinker, comprising a first clinker cooler section, a second clinker cooler section, and a crusher disposed between said sections, said device for removal of a sample of the clinker being disposed in a region between said crusher and said second cooler section.

2. Cooler as claimed in claim 1, wherein the device for removal of a sample of the clinker is disposed in a region where the temperature of the clinker is between 300° C. and 700° C.

* * * * *